United States Patent [19]

Sandell

[11] 4,225,086

[45] Sep. 30, 1980

[54] METHOD AND A DEVICE FOR ADDING MATERIAL IN AN AIR STREAM TO A NOZZLE

[76] Inventor: Bertil Sandell, Länsmansvägen 21, Hovås, Sweden, 430 80

[21] Appl. No.: 842,307

[22] Filed: Oct. 14, 1977

[30] Foreign Application Priority Data

Oct. 26, 1976 [SE] Sweden ..... 7611844

[51] Int. Cl.[2] ..... B05B 7/04

[52] U.S. Cl. ..... 239/428; 239/434.5; 239/591; 239/690; 366/11

[58] Field of Search ..... 239/431, 336, 427.5, 239/428, 434.5, 430, 15, 591, 690; 366/11

[56] References Cited

U.S. PATENT DOCUMENTS

| | | | |
|---|---|---|---|
| 1,885,645 | 11/1932 | Vawter | 366/11 |
| 2,495,540 | 1/1950 | Nichols et al. | 239/428 X |
| 2,934,241 | 4/1960 | Akesson | 239/336 X |
| 3,175,772 | 3/1965 | Marshall | 239/591 X |
| 3,327,948 | 6/1967 | Gignoux | 239/15 X |
| 3,521,815 | 7/1970 | Szasz | 239/15 |
| 3,730,763 | 5/1973 | Schlottmann et al. | 239/336 X |

FOREIGN PATENT DOCUMENTS

| | | | |
|---|---|---|---|
| 633677 | 2/1962 | Italy | 239/336 |
| 383910 | 4/1976 | Sweden . | |

*Primary Examiner*—Johnny D. Cherry
*Attorney, Agent, or Firm*—Holman & Stern

[57] ABSTRACT

Spraying of materials, which prior to the spraying operation have been mixed from two airborn material flows in a spray nozzle, results in a high wastage rate. It has now been found that this wastage can be highly reduced, if in an appropriate apparatus one of the material flows is restricted, whereas the other material flow is allowed to expand when introduced axially into and mainly in the center of the first restricted flow of material, the second expanding flow of material thereby further being used to create by ejector effect a suction acting upon the restricted flow of material.

2 Claims, 2 Drawing Figures

METHOD AND A DEVICE FOR ADDING MATERIAL IN AN AIR STREAM TO A NOZZLE

Figure 1:
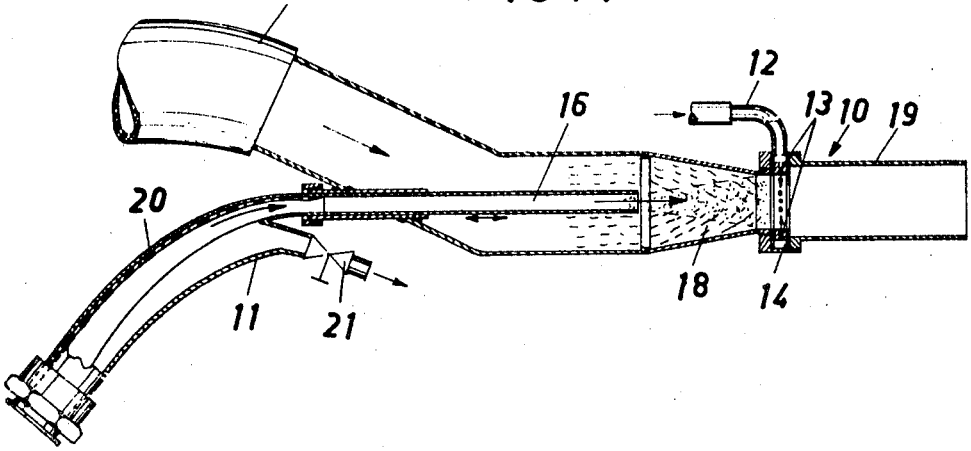

The present invention refers to a method for adding material in an air stream to a nozzle, where it may be mixed with at least a second airborn material stream, e.g. at manufacture of fibre reinforced shotcrete.

At the manufacture of fibre reinforced shotcrete constructions which show extraordinary physical properties as high impact resistance and favourable deformation properties, there is added a mixture of sand and concrete in an air stream to a spraying nozzle, where it is mixed with an airborn stream of disintegrated fibre- or rodshaped reinforcing material and with water. The concrete construction is then manufactured by spraying with the obtained mixture.

A problem at such shotcreting is that there will be a considerable fibre and concrete mass wastage when spraying on to the bedding, on one hand as material which rebounces when hitting the bedding, and on the other hand material disappearing form the material stream. This wastage partly depends on surplus air in the material stream. Quite a lot of dust is furthermore spread in the surrounding air, resulting in health risks for those persons who work with shotcrete.

It is therefore desirable for economic reasons as well as from ergonomic aspects to attain a reduction of the wastage and the forming of dust at concrete spraying by achieving a very effective mixture of the material streams in the spraying nozzle. This has according to the invention been solved thereby that one of the material streams is led axially and essentially centric into the other material stream in a mixing chamber in the spraying nozzle, that the first material stream is allowed to expand in said mixing chamber, while the other material stream is brought to be gradually compressed, whereby the first material stream by means of ejector action will effect a suction in the pipe of the other material stream.

According to a preferred embodiment the first and/or the second material stream is brought to pass a curved part of the pipe before introduction into the spraying nozzle, so that the material through centrifugal force is flung out against the outer curving path of the pipe; the material stream thus compressed being fed into the spraying nozzle through a pipe socket arranged at the part of the pipe located at the outer curving path and air and lighter particles are allowed to pass out through an outlet opening at the inner curving path.

By leading away part of the surplus air of the material stream in this way the spraying nozzle can be brought closer to the bedding than earlier and a thicker layer of concrete mass can be obtained.

In order further to reduce the wastage when spraying, the material in one of the streams, preferably the fibres, can be charged electrostatically during at least part of the passage through the tube or the pipe. An attraction is thereby received between the fibres and the concrete material owing to the potential difference between the materials.

In the following the invention will be more precisely described with reference to an embodiment shown on the enclosed drawings.

Figure 2:
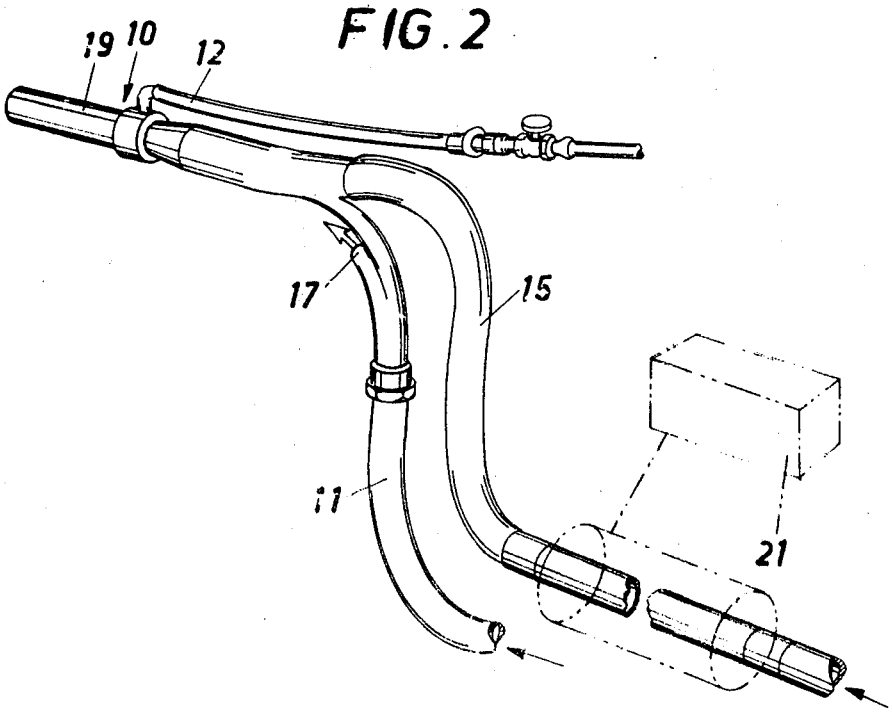

FIG. 1 is a schematic section through a device for accomplishing the method according to the invention for spraying of fibre reinforced concrete, and FIG. 2 is a perspective view of a device according to the invention, where a dash-and-dot line indicates a device for electrostatic charging the material in one of the material streams.

In FIG. 1 is shown a nozzle 10, which can be of conventional type within the field in question. A mixture of a binding agent, e.g. cement, lime, plaster or the like, and ballast material like sand, is fed in an air stream through a tube or pipe 11. A pipe 12 is used for adding water and if desired additives, e.g. an accelerator and/or means for laying the dust, to the nozzle 10 through a number of radial openings 13 in a ring chamber 14.

Disintegrated reinforcing material is fed into a tube or a pipe 15, to which is connected a source of pressurized air. The disintegrated reinforcing material is sucked into the tube 15 by ejector effect and is brought with the air stream into the spraying nozzle 10.

The pipe 11 is curved just before the inlet to the nozzle 10, whereby the solid material will be flung out by the centrifugal force towards the outer curving path of the bent part of the pipe 11. In connection to the part of the pipe 11, which is closest to the outer curving path of the curved part, there is arranged a pipe socket 16, through which the compressed material is introduced into the nozzle 10. A throttling of the material stream is effected at the entrace into the pipe socket 16, whereby an increased speed of flow is achieved. The pipe socket 16 is preferably arranged displaceable towards and away from the nozzle 10. Air and certain lighter particles as dust will not to the same degree tend to be drawn towards the outer curving path, but a large part of the air will pass out through an outlet 17 arranged at the part of the pipe 11 which is closest to the inner curving path.

The pipe socket 16 extends to a mixing chamber 18 in the spraying nozzle 10 and is located axially and essentially in the center of the pipe 15. The mixing chamber 18 tapers in the direction of flow. The cross sectional area of the pipe socket 16 is considerably smaller than that of the pipe 15, and the material stream in the pipe socket 16, i.e. the binding agent and the ballast material will expand in the mixing chamber 18, while the fibre stream will be compressed. A very effective mixing of the two material streams is thus obtained. A suction is furthermore generated in the pipe 15 by ejector effect brought about by the material stream in pipe 15.

The water is supplied through a number of radial openings 13 of a ring chamber 14, provided downstream of the mixing chamber, and to which is connected a nozzle pipe 19 with outlet opening for the mixed material stream.

A considerable wear arises at the outer curving path of the pipe and therefore this should be provided with a hard or preferably soft and elastic wear lining 20 which can be exchangable.

An adjusting- and shut-off valve 21 for controlling the amount of surplus air can be provided at the outlet 17. If a more heavy suction effect in the pipe 15 is desired, the valve 21 can be provided with a device for seperation of dust, e.g. an industrial vacuum cleaner (not shown) to ascertain that occuring dust is not spread in the surrounding air.

To further reduce the wastage and the scattering of dust the aggregating properties of the mass can be increased by electrostatic charging of the reinforcing material, e.g. the fibres and/or the sand and the cement, during the transport in the tube. A potential difference between the fibres and the concrete material is thereby obtained, whereby attraction forces arise and result in an increase of the aggregating of the mass. The electrostatical charging of the fibres can be achieved by suitable choice of the material forming the tube 15. In order to avoid too heavy a charge it is possible to make only one or a few pieces of the tube 15 of a material being highly electrostatically charging, while the other parts of the tube 15 can consist of another material which does not give the same charging effect. The charging can also be effected by means of an electrostatic aggregate 21 indicated by a dash-and-dot line in FIG. 2.

The invention is not limited to the embodiment shown but can be varied within the scope of the appended claims. Thus it is of course possible to arrange a curved path with an outlet 17 also at the pipe 15 or only at this pipe.

What I claim is:

1. Apparatus for manufacturing fiber reinforced concrete by mixing a stream of airborn concrete material with a stream of airborn reinforcing fibers, said apparatus comprising a nozzle assembly including:

a first pipe for carrying one of said streams;

a convergent mixing chamber leading from and having a junction with said first pipe;

a nozzle means leading from a discharge end of said mixing chamber;

a second pipe leading into said first pipe for carrying the other of said streams, said second pipe including a socket portion extending substantially axially through said first pipe, said socket portion terminating in a discharge end disposed substantially at the junction between said first pipe and said mixing chamber, and further including a curved portion located upstream of said socket portion, the curved portion having larger and smaller radii such that material of greater mass in said other stream is flung by centrifugal force substantially along said larger radius while material of lesser mass in said other stream is directed substantially along said smaller radius;

a discharge conduit leading from said smaller radius of said curved portion of said second pipe; and valve means disposed in said discharge conduit for controlling outflow of material of lesser mass in said other stream from said second pipe through said discharge conduit.

2. The apparatus according to claim 1 wherein said socket portion is positioned downstream of said curved portion of said second pipe to receive material of greater mass flowing in said other stream.

* * * * *